US010159340B2

(12) United States Patent
Gonzalez et al.

(10) Patent No.: US 10,159,340 B2
(45) Date of Patent: Dec. 25, 2018

(54) SHELVING SUPPORT BRACKET ASSEMBLY

(71) Applicant: SPG International LLC, Covington, GA (US)

(72) Inventors: Arturo Gonzalez, Lilburn, GA (US); Steven M. Kessell, Loganville, GA (US); Michael D. Potter, Marydel, DE (US)

(73) Assignee: SPG INTERNATIONAL LLC, Covington, GA (US)

( * ) Notice: Subject to any disclaimer, the term of this patent is extended or adjusted under 35 U.S.C. 154(b) by 0 days.

(21) Appl. No.: 15/673,119

(22) Filed: Aug. 9, 2017

(65) Prior Publication Data

US 2017/0332781 A1 Nov. 23, 2017

Related U.S. Application Data

(63) Continuation of application No. 14/840,254, filed on Aug. 31, 2015, which is a continuation of application
(Continued)

(51) Int. Cl.
*A47B 96/06* (2006.01)
*A47B 57/48* (2006.01)
(Continued)

(52) U.S. Cl.
CPC ..... *A47B 57/485* (2013.01); *A47B 96/06* (2013.01); *A47B 96/061* (2013.01);
(Continued)

(58) Field of Classification Search
None
See application file for complete search history.

(56) References Cited

U.S. PATENT DOCUMENTS 239,909 A 4/1881 Woodward
291,030 A 1/1884 Clapper
(Continued)

FOREIGN PATENT DOCUMENTS

CN 1132999 10/1995
CN 101868166 A 10/2010
(Continued)

OTHER PUBLICATIONS

International Search Report and Written Opinion received in International Patent Application No. PCT/US2014/026525 dated Jul. 28, 2014 (11 pages).
(Continued)

*Primary Examiner* — Nkeisha Smith
(74) *Attorney, Agent, or Firm* — Michael Best & Friedrich LLP

(57) ABSTRACT

A shelving system includes a support post having a mounting surface and a plurality of vertically spaced retention members extending from the mounting surface. A shelf includes a bracket member configured for coupling to a first of the vertically spaced retention members. A support bracket includes an attachment portion configured for coupling to a second of the vertically spaced retention members adjacent the first vertically spaced retention member and a support portion configured for coupling to the bracket member.

42 Claims, 6 Drawing Sheets

Related U.S. Application Data

No. 13/830,962, filed on Mar. 14, 2013, now Pat. No. 9,119,471.

(51) Int. Cl.
*A47B 96/14* (2006.01)
*A47B 57/00* (2006.01)
*A47B 57/30* (2006.01)

(52) U.S. Cl.
CPC ..... *A47B 96/1408* (2013.01); *A47B 57/00* (2013.01); *A47B 57/30* (2013.01)

(56) References Cited

U.S. PATENT DOCUMENTS 309,360 A 12/1884 Roberts
663,784 A 12/1900 Porter
870,439 A 11/1907 Kade
1,424,284 A * 8/1922 Dyke ..... F16B 12/58 5/296
1,560,122 A 11/1925 Vance
1,582,100 A 4/1926 Troppman
1,620,841 A 3/1927 Vance
1,698,974 A 1/1929 Vance
1,702,937 A * 2/1929 Friedemann ..... A47F 3/12 248/242
1,983,858 A 12/1934 Karnes
2,008,180 A 7/1935 Karnes
2,246,090 A 6/1941 Filer
2,263,282 A 11/1941 Welch et al.
2,534,952 A 12/1950 Comer
2,693,884 A 11/1954 Gurries
2,772,846 A 12/1956 Skar
2,788,949 A 4/1957 Gurries
2,790,559 A 4/1957 Stephenson et al.
2,912,119 A 11/1959 Robinson
2,919,034 A 12/1959 Levy
2,933,196 A 4/1960 Childs
2,940,601 A 6/1960 Smith
2,940,603 A 6/1960 Riedmaier et al.
2,971,805 A 2/1961 Weiss
2,975,908 A 3/1961 Huet
2,983,389 A 5/1961 Trautmann
3,018,900 A 1/1962 Huet
RE25,156 E 4/1962 Gingher et al.
3,040,905 A 6/1962 Gingher et al.
3,044,632 A 7/1962 Schild
3,044,634 A 7/1962 Oztekin
3,057,483 A 10/1962 Derman
3,097,822 A 7/1963 Attwood
3,100,572 A 8/1963 Gingher et al.
3,127,146 A 3/1964 Fisher
3,130,693 A 4/1964 Shell
3,184,068 A 5/1965 Wende
3,194,528 A 7/1965 Chesley
3,199,822 A 8/1965 Ruhnke
3,207,322 A 9/1965 Pedersen
3,212,648 A 10/1965 Baker, Jr. et al.
3,216,377 A 11/1965 Gunn
3,221,678 A 12/1965 Doherty
3,229,822 A 1/1966 Janus
3,229,823 A 1/1966 Hummer
3,250,584 A 5/1966 Tassell
3,273,847 A 9/1966 Berman
3,294,351 A 12/1966 Rollins, Jr.
3,316,863 A 5/1967 Zock
3,353,684 A 11/1967 Chesley
3,355,134 A 11/1967 Chesley
3,358,956 A 12/1967 Thornton
3,371,798 A 3/1968 D'Altrui
3,450,270 A 6/1969 Brown
3,471,112 A 10/1969 MacDonald et al.
3,479,975 A 11/1969 Ferdinand et al.
3,495,718 A 2/1970 Romero
3,512,654 A 5/1970 Olsen et al.
3,517,623 A 6/1970 Goldstein et al.
3,556,306 A 1/1971 Shell
3,561,608 A 2/1971 Weider et al.
3,565,020 A 2/1971 Schier
3,565,381 A 2/1971 Oliver
3,572,626 A 3/1971 Bertschi
3,587,867 A 6/1971 Fenwick
3,595,404 A 7/1971 Goldstein
3,602,159 A 8/1971 Marschak
3,602,374 A 8/1971 Alabaster
3,612,291 A 10/1971 Skubic
3,627,247 A 12/1971 Krikorian
3,631,821 A 1/1972 Zachariou
3,645,486 A 2/1972 Ferdinand et al.
3,695,569 A 10/1972 Pullan
3,701,325 A 10/1972 Fenwick
3,730,108 A 5/1973 Stroh
3,740,776 A * 6/1973 Lazarus ..... A47C 19/022 5/296
3,759,191 A 9/1973 Freeman
3,765,344 A 10/1973 Ferdinand et al.
3,784,025 A 1/1974 Dumit
3,793,655 A 2/1974 Harris et al.
3,827,377 A 8/1974 Aughtry, Jr.
3,854,686 A 12/1974 Konstant
3,885,675 A 5/1975 Hultenby et al.
3,993,002 A 11/1976 Stroh
4,018,167 A 4/1977 Spangler
4,064,996 A 12/1977 Shillum
4,098,480 A 7/1978 Neumann
4,101,108 A 7/1978 Klein
4,109,797 A 8/1978 Brunette
4,116,509 A 9/1978 Smith
4,122,955 A 10/1978 Celms
4,146,140 A 3/1979 Suter et al.
4,150,753 A 4/1979 Stahl et al.
4,174,086 A 11/1979 Verberkmoes
4,189,123 A 2/1980 Johnson
4,190,002 A 2/1980 Redemann
4,197,950 A 4/1980 Ovitz, III
4,201,139 A * 5/1980 Suttles ..... A47B 57/40 108/109
4,205,815 A 6/1980 Sauer et al.
4,230,052 A 10/1980 Champagne
4,285,436 A 8/1981 Konstant et al.
4,286,719 A 9/1981 Hall
4,312,086 A 1/1982 Bianco
4,332,204 A 6/1982 Hewell
4,360,181 A 11/1982 Burkholder
4,367,819 A 1/1983 Lewis
4,378,925 A 4/1983 Griffin
4,390,302 A 6/1983 Sanfeliu-Marimon
4,396,125 A 8/1983 Rowader
4,397,432 A 8/1983 Resetar
4,444,323 A 4/1984 Travis
4,455,007 A 6/1984 Varon et al.
4,534,529 A 8/1985 Dorner
4,589,349 A 5/1986 Gebhardt et al.
4,592,286 A 6/1986 Trubiano
4,615,503 A 10/1986 Garfinkle
4,623,065 A 11/1986 Cooper
4,624,376 A 11/1986 Bertram
4,627,543 A 12/1986 Nicely
4,684,094 A 8/1987 Everett
4,700,916 A 10/1987 Bastian et al.
4,938,442 A 7/1990 Mastrodicasa
4,951,908 A 8/1990 Kallio
4,960,210 A 10/1990 Spamer
D311,858 S 11/1990 Richmond
5,022,541 A 6/1991 White
5,054,404 A 10/1991 Melgers
5,069,408 A 12/1991 Bessinger
5,074,422 A 12/1991 Holtz
5,080,238 A 1/1992 Hochman
5,116,007 A 5/1992 Von Gunton et al.
5,127,342 A 7/1992 Taylor
5,161,701 A 11/1992 Berny
D331,873 S 12/1992 Finkelstein et al.
D333,059 S 2/1993 Cohn et al.

(56) References Cited

U.S. PATENT DOCUMENTS 5,205,630 A 4/1993 Welch
5,221,014 A 6/1993 Welch et al.
5,230,492 A 7/1993 Zwart et al.
D339,704 S 9/1993 Cohn et al.
5,263,595 A 11/1993 Hilstolsky
5,265,740 A 11/1993 Hodsden et al.
5,269,419 A 12/1993 Aldeguer et al.
5,288,046 A 2/1994 Eklof et al.
5,297,486 A 3/1994 Herrmann et al.
5,303,645 A 4/1994 Meacham
5,305,898 A 4/1994 Merl
5,346,077 A 9/1994 Randall
5,350,074 A 9/1994 Rosenband
5,351,842 A 10/1994 Remmers
5,365,860 A 11/1994 Billington, III
5,390,803 A 2/1995 McAllister
5,405,114 A 4/1995 Dias
D358,321 S 5/1995 Tayar
5,415,302 A 5/1995 Carlson et al.
5,417,396 A 5/1995 Merl
5,423,251 A 6/1995 Kolvites et al.
5,437,426 A 8/1995 MacDonald
5,443,167 A 8/1995 Menaged et al.
5,454,638 A 10/1995 Bird et al.
5,456,435 A 10/1995 Sweeney
5,456,438 A 10/1995 Long
5,472,103 A 12/1995 Merl
5,477,971 A 12/1995 Howard
5,482,168 A 1/1996 Welch et al.
5,509,541 A 4/1996 Merl
5,518,127 A 5/1996 Warmack et al.
5,522,324 A 6/1996 van Gelder et al.
5,531,168 A 7/1996 Towfigh
5,575,444 A 11/1996 Otema
5,592,886 A 1/1997 Williams et al.
5,605,238 A 2/1997 Jacobs
5,611,440 A 3/1997 Moller
5,613,449 A 3/1997 Pullman
5,641,081 A 6/1997 Merl
5,645,257 A 7/1997 Ward
5,647,650 A 7/1997 Daugherty et al.
5,655,740 A 8/1997 Lazarus
5,680,942 A 10/1997 McAllister et al.
5,695,163 A 12/1997 Tayar
5,715,957 A 2/1998 Merl
5,769,247 A 6/1998 Merl
5,794,902 A 8/1998 Henry et al.
5,797,501 A 8/1998 Von Gunten
5,797,503 A 8/1998 Stevens
5,806,820 A 9/1998 Simon
5,816,419 A 10/1998 Lamson
5,833,083 A 11/1998 Miller
5,868,263 A 2/1999 McAllister et al.
5,884,567 A 3/1999 Bartz, Jr.
5,908,119 A 6/1999 Kump et al.
5,915,803 A 6/1999 Daugherty
5,921,190 A 7/1999 Wood
5,921,411 A 7/1999 Merl
5,921,414 A 7/1999 Burke et al.
D415,365 S 10/1999 Nicklas
5,970,887 A 10/1999 Hardy
5,979,677 A 11/1999 Simpson, II et al.
6,017,009 A 1/2000 Swartz et al.
6,019,331 A 2/2000 Hoogland et al.
6,024,333 A 2/2000 Raasch et al.
6,029,833 A 2/2000 Yeh
6,053,115 A 4/2000 Felton
6,062,401 A 5/2000 Hall et al.
6,082,690 A 7/2000 Durin et al.
6,109,461 A 8/2000 Kluge et al.
6,116,436 A 9/2000 Ferrucci et al.
6,129,224 A 10/2000 Mingers
6,158,599 A 12/2000 Lazarus
6,182,937 B1 2/2001 Sanderse
6,230,907 B1 5/2001 Stuart
6,253,687 B1 7/2001 McAllister
6,267,064 B1 7/2001 Ostertag et al.
6,269,906 B1 8/2001 Dockter et al.
6,302,283 B1 10/2001 Yeh
6,345,795 B1 2/2002 Bartz, Jr.
6,431,090 B1 8/2002 Davis et al.
D462,541 S 9/2002 Welch
6,460,946 B1 10/2002 Beukema
6,481,678 B1 * 11/2002 Chong ..... H02G 3/288 211/192
6,555,740 B2 4/2003 Roth et al.
6,584,916 B1 7/2003 Felton et al.
6,625,935 B1 9/2003 King et al.
6,659,295 B1 12/2003 De Land et al.
6,666,344 B1 12/2003 Schneider
6,675,725 B2 1/2004 Felton et al.
6,726,035 B2 4/2004 Zadak
RE38,517 E 5/2004 Pfeiffer et al.
6,848,589 B2 2/2005 Wood
6,918,499 B2 7/2005 De Land et al.
6,932,225 B2 8/2005 Rowe
6,935,518 B2 8/2005 Winig et al.
6,971,528 B2 12/2005 Chen
7,040,494 B2 5/2006 Harper
7,086,543 B2 8/2006 Remmers
7,128,223 B1 * 10/2006 Sarnoff ..... A47F 5/083 211/103
7,147,114 B2 12/2006 Sarnoff et al.
7,150,361 B2 12/2006 Calleja
7,191,907 B2 3/2007 Conway
7,191,908 B2 3/2007 De Rijk
7,240,803 B2 7/2007 Stitchick et al.
7,258,317 B1 8/2007 Nagel
7,284,671 B1 10/2007 Doscher
7,311,211 B2 12/2007 Chung
7,350,649 B1 4/2008 Martens
7,357,362 B2 * 4/2008 Yang ..... H05K 7/1489 248/220.22
7,378,213 B2 5/2008 Smalley
7,387,212 B2 6/2008 Costa et al.
7,387,213 B1 * 6/2008 Smalley ..... A47B 57/482 211/106
7,401,705 B2 7/2008 Craft
7,404,533 B1 7/2008 Kologe
7,407,060 B2 8/2008 Swartz et al.
7,494,019 B2 * 2/2009 Kessell ..... A47B 57/06 108/108
7,497,344 B2 * 3/2009 Chen ..... A47B 57/40 108/108
7,506,772 B2 3/2009 Chen
7,523,903 B1 4/2009 Rindoks et al.
7,568,436 B2 8/2009 McAllister et al.
7,654,497 B1 2/2010 Karan
7,677,514 B1 3/2010 Palmer
7,762,411 B2 * 7/2010 Hilburn ..... H05K 7/1489 211/192
7,810,438 B2 10/2010 Ryberg
7,832,571 B2 11/2010 Felsenthal
7,900,783 B2 3/2011 Fernandez et al.
7,967,156 B2 6/2011 Hsu
7,967,268 B2 * 6/2011 Herron, III ..... A47B 57/42 108/106
7,992,731 B2 8/2011 McAllister et al.
8,025,163 B2 9/2011 McAllister et al.
8,028,846 B2 10/2011 Peota et al.
8,087,521 B2 1/2012 Schwartzkopf et al.
8,113,678 B2 2/2012 Babcock et al.
8,118,181 B2 2/2012 Shinozaki
8,141,724 B2 2/2012 Northam et al.
8,152,119 B2 * 4/2012 Pfund ..... F21S 8/00 248/220.21
8,235,339 B2 8/2012 Selvidge et al.
8,424,466 B2 4/2013 Botkin
8,468,844 B2 6/2013 Nagel et al.
8,584,873 B2 11/2013 Horn et al.
8,596,590 B2 12/2013 McCoy
8,602,372 B2 12/2013 Yu et al.
8,646,624 B2 2/2014 Fernandez et al.

(56) References Cited

U.S. PATENT DOCUMENTS

| | | | | |
|---|---|---|---|---|
| D702,467 | S | 4/2014 | Huang et al. | |
| 8,967,576 | B2 | 3/2015 | Knoll et al. | |
| 9,119,471 | B2 | 9/2015 | Gonzalez et al. | |
| 9,173,506 | B2 | 11/2015 | Andersson et al. | |
| 9,277,814 | B2 | 3/2016 | Winker | |
| 9,339,108 | B2 | 5/2016 | Zang et al. | |
| 9,770,122 | B2 | 9/2017 | Gonzalez et al. | |
| D808,200 | S | 1/2018 | Davis et al. | |
| 9,883,755 | B2 | 2/2018 | Gonzalez et al. | |
| 2002/0104938 | A1* | 8/2002 | Simard | A47B 57/34 248/218.4 |
| 2003/0037712 | A1 | 2/2003 | Welch et al. | |
| 2003/0160012 | A1 | 8/2003 | Kanouchi et al. | |
| 2003/0234231 | A1 | 12/2003 | Rowe | |
| 2004/0020885 | A1 | 2/2004 | Newman | |
| 2004/0045919 | A1 | 3/2004 | Remmers | |
| 2004/0050814 | A1 | 3/2004 | Roush et al. | |
| 2004/0154498 | A1 | 8/2004 | Borgen et al. | |
| 2004/0159622 | A1 | 8/2004 | Craft et al. | |
| 2004/0173549 | A1 | 9/2004 | Herron, III et al. | |
| 2004/0182805 | A1 | 9/2004 | Harper | |
| 2005/0045787 | A1 | 3/2005 | Magnusson | |
| 2005/0056604 | A1 | 3/2005 | Chen | |
| 2005/0092706 | A1 | 5/2005 | Chang | |
| 2005/0103733 | A1 | 5/2005 | Saltzberg et al. | |
| 2005/0103734 | A1 | 5/2005 | Saltzberg et al. | |
| 2005/0127017 | A1 | 6/2005 | Kessel et al. | |
| 2005/0145147 | A1 | 7/2005 | Costa et al. | |
| 2005/0145588 | A1 | 7/2005 | Stitchick et al. | |
| 2005/0150850 | A1 | 7/2005 | Stitchick et al. | |
| 2005/0199568 | A1 | 9/2005 | Gay, II et al. | |
| 2006/0054577 | A1 | 3/2006 | Strating et al. | |
| 2006/0091088 | A1 | 5/2006 | McCoy | |
| 2006/0175495 | A1 | 8/2006 | Gregory | |
| 2006/0213849 | A1 | 9/2006 | Bienick | |
| 2007/0110511 | A1 | 5/2007 | Chen | |
| 2007/0114348 | A1 | 5/2007 | Nawrocki | |
| 2007/0138362 | A1 | 6/2007 | McAllister et al. | |
| 2007/0241072 | A1 | 10/2007 | Bryant et al. | |
| 2007/0295681 | A1 | 12/2007 | Colin | |
| 2008/0047914 | A1 | 2/2008 | Young | |
| 2008/0083685 | A1* | 4/2008 | Chen | A47F 5/0018 211/134 |
| 2008/0128373 | A1 | 6/2008 | Chang et al. | |
| 2008/0142463 | A1 | 6/2008 | Johnson | |
| 2008/0179267 | A1 | 7/2008 | Johnson | |
| 2008/0217496 | A1 | 9/2008 | Wooten | |
| 2008/0237426 | A1 | 10/2008 | Walters | |
| 2009/0014400 | A1 | 1/2009 | Nawrocki | |
| 2009/0139943 | A1 | 6/2009 | Fernandez | |
| 2010/0032394 | A1 | 2/2010 | Wang | |
| 2010/0140202 | A1 | 6/2010 | Janis | |
| 2010/0155353 | A1 | 6/2010 | McAllister et al. | |
| 2010/0163504 | A1 | 7/2010 | Freeman | |
| 2010/0200716 | A1* | 8/2010 | White, III | H05K 7/1489 248/243 |
| 2010/0327135 | A1 | 12/2010 | Selvidge et al. | |
| 2011/0168651 | A1 | 7/2011 | Stenftenagel et al. | |
| 2011/0220602 | A1 | 9/2011 | Chen | |
| 2012/0175330 | A1 | 7/2012 | Nicholls et al. | |
| 2012/0255924 | A1 | 10/2012 | Kologe | |
| 2012/0273447 | A1 | 11/2012 | Stitchick et al. | |
| 2012/0292271 | A1 | 11/2012 | Bevelacqua | |
| 2013/0020272 | A1 | 1/2013 | Kropveld | |
| 2013/0020452 | A1 | 1/2013 | Yu et al. | |
| 2013/0021391 | A1 | 1/2013 | Rui | |
| 2014/0263125 | A1 | 9/2014 | Gonzalez et al. | |
| 2015/0335155 | A1 | 11/2015 | Winker | |
| 2015/0366339 | A1 | 12/2015 | Gonzalez et al. | |
| 2016/0015174 | A1 | 1/2016 | Guizzardi | |
| 2017/0310090 | A1 | 10/2017 | Woodley et al. | |
| 2017/0332782 | A1 | 11/2017 | Castro | |
| 2017/0340108 | A1 | 11/2017 | Gonzalez et al. | |
| 2017/0340142 | A1 | 11/2017 | Gonzalez et al. | |

FOREIGN PATENT DOCUMENTS

| | | | |
|---|---|---|---|
| CN | 102131426 | A | 7/2011 |
| DE | 1138902 | | 10/1962 |
| DE | 2824605 | A1 | 12/1979 |
| DE | 9109395 | | 9/1991 |
| DE | 20215552 | U1 | 2/2003 |
| FR | 1515478 | | 3/1968 |
| GB | 608480 | A | 9/1948 |
| GB | 1025357 | | 1/1963 |
| GB | 1149568 | | 6/1967 |
| GB | 2194134 | | 3/1988 |
| KR | 101267731 | B1 | 5/2013 |
| WO | 9529613 | A1 | 11/1995 |
| WO | 03088782 | A2 | 10/2003 |
| WO | 2005046401 | | 5/2005 |
| WO | 2013071977 | A1 | 5/2013 |

OTHER PUBLICATIONS

Extended European Search Report for Application No. 14775083.0 dated Feb. 15, 2017 (8 pages).

First Office Action and Search Report from the State Intellectual Property Office of the People's Republic of China for Application No. 201480024336.X dated Dec. 28, 2016 (16 pages).

Extended European Search Report for Application No. 14775083.0 dated Jun. 21, 2017 (9 pages).

Metro, "Metro Cantilevered Freestanding Shelving System," article (2001) 5 pages, www.metro.com.

Eagle Group, "Cantilever Shelving," article, EG7010 Rev. 3 (2005) 4 pages, www.eaglegrp.com.

Modern Equipment Company, Inc., "Meco Omaha Cantilever Rack, Buyers Guide" online brochure (2001) 12 pages.

Modern Equipment Company, Inc., "Instructions for Assembling Meco Omaha Series 2000 Medium-Heavy Duty Cantilever Rack" online brochure (2013) 6 pages, www.meco-omaha.com.

EZ Shelving Systems, Inc., "Manufacturer of Space-Saving Cantilever Shelving & Hardware," catalog (2005) pp. 1-8, Merriam, USA website: www.e-zshelving.com.

EZ Shelving Systems, Inc., "Manufacturer of Space-Saving Cantilever Shelving & Hardware," catalog (2008) pp. 1-4, Merriam, USA website: www.e-zshelving.com.

Second Office Action and Search Report from the State Intellectual Property Office of the People's Republic of China for Application No. 201480024336.X dated Aug. 21, 2017 (8 pages).

U.S. Appl. No. 15/675,368, filed Aug. 11, 2017, in re Arturo Gonzalez, entitled "Shelving System" (27 pages).

Office Action received in U.S. Appl. No. 15/675,368, dated Oct. 6, 2017 (7 pages).

Complaint for Patent Infringement, U.S. District Court, Middle District of Tennessee Nashville Division, *SPG International, LLC* v. *Intermetro Industries Corp*, Case No. 13:18-cv-00116, filed Feb. 8, 2018 (6 pages).

U.S. Appl. No. 15/886,636, filed Feb. 1, 2018, in re Arturo Gonzalez, entitled "Shelving System" (27 pages).

Defendant's Amended Answer and Counterclaims, U.S. District Court, Middle District of Tennessee Nashville Division, *SPG International, LLC* v. *Intermetro Industries Corp*, Case No. 13:18-cv-00116, filed Apr. 5, 2018 (18 pages).

Limited Warranty and Assembly Instructions, Nexel Industries Inc., believed to be available to the public before Mar. 14, 2013, (3 pages).

"Cantilever Shelving System," catalog, Nexel Industries Inc., believed to be available to the public before Mar. 14, 2013, Nexelwire.com, (1 page).

"Corrosion Resistant Cantilever Rack," website, Global Industrial, Nov. 18, 2011, globalindustrial.com, (2 pages).

"Corrosion Resistant Cantilever Rack Upright," website, Global Industrial, Oct. 17, 2011, globalindustrial.com, (3 pages).

"Storage and Handling Equipment," catalog, Nexel Industries Inc., Jul. 24, 2010, http://www.nexelwire.com:80/catalog/, (1 page).

"Shelf Types," catalog, Nexel Industries Inc., Sep. 28, 2010, (58 pages).

(56) References Cited

OTHER PUBLICATIONS

Statement of Relevance with photo of shelving system asserted by Defendant in *SPG International, LLC* v. *Intermetro Industries Corp*, Case No. 3:18-cv-00116 as a cantilever shelving system made by Nexel Industries, Inc. and available to the public since at least about Oct. 2011, (2 pages).
Statement of Relevance with photos showing select components of a cantilever shelving system of Nexel Products, Inc., believed to be available to the public before Mar. 14, 2013, (11 pages).
"Button-On Cantilever Rack Specification," webpage, https://web.archive.org/web/20061019070526/http://www.jarke.com/pro . . . ; Jarke, Prospect Heights, IL, 2006, produced by InterMetro Industries Corp in Case No. 13:18-cv-00116, *SPG International, LLC* v. *InterMetro Industries Corp*, (3 pages).
"Cantilevered Shelving System—Heavy Duty Components," Eagle Group, Clayton, DE, specification sheet, 2010, produced by InterMetro Industries Corp in Case No. 13:18-cv-00116, *SPG International, LLC* v. *InterMetro Industries Corp*, (2 pages).
"Cantilever Shelving," Eagle Group, Clayton, DE, catalog, 2005, produced by InterMetro Industries Corp in Case No. 13:18-cv-00116, *SPG International, LLC* v. *InterMetro Industries Corp*, (4 pages).
"Chapter 3—Installing FlexWorks Accessories," Lista International Corporation, Holliston, MA, guide, 2000, produced by InterMetro Industries Corp in Case No. 13:18-cv-00116, *SPG International, LLC* v. *InterMetro Industries Corp*, (14 pages).
"FreedomRail Installation Guide," Organized Living, Cincinnati, OH, guide, 2009, produced by InterMetro Industries Corp in Case No. 13:18-cv-00116, *SPG International, LLC* v. *InterMetro Industries Corp*, (3 pages).
"HD Super Work Center With Overhead," InterMetro Industries Corporation, Wilkes-Bane, PA, specification sheet, 1999, produced by InterMetro Industries Corp in Case No. 13:18-cv-00116, *SPG International, LLC* v. *InterMetro Industries Corp*, (2 pages).
"Shelving and Shelving Solutions," Eagle Group, Clayton, DE, catalog, 2009, produced by InterMetro Industries Corp in Case No. 13:18-cv-00116, *SPG International, LLC* v. *InterMetro Industries Corp*, (16 pages).
"Material Handling and Industrial Storage Solutions," SPG International, LLC, Covington, GA, Catalog, 2010, produced by InterMetro Industries Corp in Case No. 13:18-cv-00116, *SPG International, LLC* v. *InterMetro Industries Corp*, (27 pages).
"Super Erecta Shelf Post-Type and Direct Wall Mounts," InterMetro Industries, Wilkes-Bane, PA, specification sheet, 2000, produced by InterMetro Industries Corp in Case No. 13:18-cv-00116, *SPG International, LLC* v. *InterMetro Industries Corp*, (2 pages).
"Wire Basket with Brackets 36"×16," Global Equipment Company, Inc., https://web.archive.org/web/20120507140028/http://www.globalindustria\'85; web page, 2012, produced by InterMetro Industries Corp in Case No. 13:18-cv-00116, *SPG International, LLC* v. *InterMetro Industries Corp*, (3 pages).
Extended European Search Report for Application No. 18156976.5, dated May 15, 2018, European Patent Office, produced by InterMetro Industries Corp in Case No. 13:18-cv-00116, *SPG International, LLC* v. *InterMetro Industries Corp*, (4 pages).
"Corrosion Resistant Cantilever Rack—Adjustable Width Uprights & Frame (Only)," Global Industrial, 2011, Port Washington, NY, produced by InterMetro Industries Corp in Case No. 13:18-cv-00116, *SPG International, LLC* v. *InterMetro Industries Corp*., (12 pages).
"Cantilever Shelving Unit Assembly Instruction," Nexel Industries, instruction sheet, assumed publicly available prior to 2011, produced by InterMetro Industries Corp in Case No. 13:18-cv-00116, *SPG International, LLC* v. *InterMetro Industries Corp*, (2 pages).
"Freestyle Modular Cantilever Shelving System," SPG International, LLC, Covington, GA, specification, 2016, produced by InterMetro Industries Corp in Case No. 13:18-cv-00116, *SPG International, LLC* v. *InterMetro Industries Corp*, (9 pages).
International Search Report and Written Opinion received in International Patent Application No. PCT/US2014/058308, dated Jan. 5, 2015, produced by InterMetro Industries Corp in Case No. 13:18-cv-00116, *SPG International, LLC* v. *InterMetro Industries Corp*, (9 pages).
First Office Action and Search Report from the State Intellectual Property Office of the People's Republic of China for Application No. 201480060558.7, dated Jun. 27, 2017, produced by InterMetro Industries Corp in Case No. 13:18-cv-00116, *SPG International, LLC* v. *InterMetro Industries Corp*, (10 pages).
Extended European Search Report for Application No. 14851078.7, dated Jun. 28, 2017, produced by InterMetro Industries Corp in Case No. 13:18-cv-00116, *SPG International, LLC* v. *InterMetro Industries Corp*, (8 pages).
U.S. Appl. No. 15/673,119, filed Aug. 9, 2017, Arturo Gonzalez et al., entitled "Support Bracket," produced by InterMetro Industries Corp in Case No. 13:18-cv-00116, *SPG International, LLC* v. *InterMetro Industries Corp*, (25 pages).
U.S. Appl. No. 15/678,909, filed Aug. 16, 2017, Arturo Gonzalez et al., entitled "Support Bracket," produced by InterMetro Industries Corp in Case No. 13:18-cv-00116, *SPG International, LLC* v. *InterMetro Industries Corp*, (23 pages).
Office Action received in U.S. Appl. No. 14/840,254, dated Sep. 29, 2017, produced by InterMetro Industries Corp in Case No. 13:18-cv-00116, *SPG International, LLC* v. *InterMetro Industries Corp*, (8 pages).
Office Action received in U.S. Appl. No. 15/673,119, dated Oct. 2, 2017, produced by InterMetro Industries Corp in Case No. 13:18-cv-00116, *SPG International, LLC* v. *InterMetro Industries Corp*, (14 pages).
Office Action received in U.S. Appl. No. 15/678,909, dated Oct. 6, 2017, produced by InterMetro Industries Corp in Case No. 13:18-cv-00116, *SPG International, LLC* v. *InterMetro Industries Corp*, (20 pages).
Defendant InterMetro Industries Corp.'s Invalidity Contentions, U.S. District Court, Middle District of Tennessee Nashville Division, *SPG International, LLC* v. *Intermetro Industries Corp*, Case No. 13:18-cv-00116, (28 pages).
Extended European Search Report for Application No. 14775083.0, dated Feb. 15, 2017, produced by InterMetro Industries Corp in Case No. 13:18-cv-00116, *SPG International, LLC* v. *InterMetro Industries Corp*, (8 pages).
First Office Action and Search Report from the State Intellectual Property Office of the People's Republic of China for Application No. 21480024336.X, dated Dec. 28, 2016, produced by InterMetro Industries Corp in Case No. 13:18-cv-00116, *SPG International, LLC* v. *InterMetro Industries Corp*, (16 pages).
"Metro Cantilevered Freestanding Shelving System," InterMetro Industries Corp., article, Wilkes-Barre, PA, 1993, produced by InterMetro Industries Corp in Case No. 13:18-cv-00116, *SPG International, LLC* v. *InterMetro Industries Corp*, (5 pages).
"Material Handling and Industrial Storage Solutions," SPG International, LLC, Covington, GA, Catalog, 2010, (97 pages).
Select components and views of a shelving system, Global Industrial (www.globalindustrial.com), produced by InterMetro Industries Corp in Case No. 13:18-cv-00116, *SPG International, LLC* v. *InterMetro Industries Corp* (19 pages).
"Cantilever Racks," All American Rack Company Warehouse Pallet Rack & Shelving (www.aarack.com/cantilever-racks/cantilever-racks/), produced by InterMetro Industries Corp in Case No. 13:18-cv-00116, *SPG International, LLC* v. *InterMetro Industries Corp* (2 pages).
"E-Z Walk-In Cooler/Freezer Shelving Systems," E-Z Shelving Systems, Inc., Merriam, KS, May 7, 2016, produced by InterMetro Industries Corp in Case No. 13:18-cv-00116, *SPG International, LLC* v. *InterMetro Industries Corp* (8 pages).
"E-Z Shelving Systems Basic Components," E-Z Shelving Systems, Inc., Merriam, KS, produced by InterMetro Industries Corp in Case No. 13:18-cv-00116, *SPG International, LLC* v. *InterMetro Industries Corp* (1 page).
"E-Z for 50 Years, Cantilever Shelving & Hardware," E-Z Shelving Systems, Inc., Merriam, KS, catalog, 2008, produced by InterMetro Industries Corp in Case No. 13:18-cv-00116, *SPG International, LLC* v. *InterMetro Industries Corp* (4 pages).

(56) References Cited

OTHER PUBLICATIONS

"Cantilever," unreferenced image, produced by InterMetro Industries Corp in Case No. 13:18-cv-00116, *SPG Intemational, LLC* v. *InterMetro Industries Corp* (1 page).
"Quick Change Cantilever System," New Age Industrial Corp., Inc., Norton, Kansas, produced by InterMetro Industries Corp in Case No. 13:18-cv-00116, *SPG International, LLC* v. *InterMetro Industries Corp* (2 pages).
"Pick Racks, Trucks & Cantilever Shelving," produced by InterMetro Industries Corp in Case No. 13:18-cv-00116, *SPG International, LLC* v. *InterMetro Industries Corp* (1 page).
"Metro Workspace Adjustable Workstations", InterMetro Industries Corporation, Wilkes-Barre, PA, 2001, produced by InterMetro Industries Corp in Case No. 13:18-cv-00116, *SPG International, LLC* v. *InterMetro Industries Corp* (4 pages).
"Sandwich Unit Refrigerator Model: SW48-12," Continental Refrigerator, Bensalem, PA, catalog, 2013, produced by InterMetro Industries Corp in Case No. 13:18-cv-00116, *SPG International, LLC* v. *InterMetro Industries Corp* (2 pages).
"Cantilever Metal Storage System," E-Z Shelving Systems, Inc., Merriam, KS, Product Guide Specification, Aug. 2011 (21 pages).
"Foodservice Cantilever Metal Storage System," E-Z Shelving Systems, Inc., Merriam, KS, Product Guide Specification, Aug. 2011 (19 pages).
"Shelving," New Age Industrial (www.newageindustrial.com:80/CategoryDetail.aspx?ISC_Category=Shelving), 2008 (1 page).
"New Age Industrial Aluminum Solutions," New Age Industrial Corporation, Inc., catalog, 2012 (72 pages).
"Sandwich Unit Refrigerator Model: SW48-12M-FB-D," Continental Refrigerator, Bensalem, PA, catalog, 2013 (2 pages).
"Sandwich Unit Refrigerator Model: SW48-12-FB," Continental Refrigerator, Bensalem, PA, catalog, 2013 (2 pages).
"Cantilever Shelving—New Age Industrial," (www.newageindustrial.com/PublicStore/Catalog/CategoryInfo.aspx?cid=191&sort=Name&itemsperpage=36&view=Grid&currentpage=1) (11 pages).
"New Age Industrial—Cantilevered Shelving," YouTube page, Apr. 16, 2011 (www.youtube.com/watch?v=Jm5aMXPcTsI) (2 pages).
Exhibit A, "Asserted Claims 1, 2, 3, 5, 7, 9, 11, 12, 14 and 16 of U.S. Pat. No. 9,883,755 are Invalid in View of Karnes," submitted by InterMetro Industries Corp in Case No. 13:18-cv-00116, *SPG International, LLC* v. *InterMetro Industries Corp*, (18 pages).
Exhibit B, "The Asserted Claims of U.S. Pat. No. 9,883,755 are Invalid Over Jensen et al. in View of Kessel et al.," submitted by InterMetro Industries Corp in Case No. 13:18-cv-00116, *SPG International, LLC* v. *InterMetro Industries Corp*, (26 pages).
Exhibit C, "The Asserted Claims of U.S. Pat. No. 9,883,755 are Invalid Over Jensen et al. in View of Mason," submitted by InterMetro Industries Corp in Case No. 13:18-cv-00116, *SPG International, LLC* v. *InterMetro Industries Corp*, (26 pages).
Exhibit D, "The Asserted Claims of U.S. Pat. No. 9,883,755 are Invalid Over Andersson et al. in View of Kessel et al.," submitted by InterMetro Industries Corp in Case No. 13:18-cv-00116, *SPG International, LLC* v. *InterMetro Industries Corp*, (26 pages).
Exhibit E, "The Asserted Claims of U.S. Pat. No. 9,883,755 are Invalid Over Andersson et al. in View of Mason," submitted by InterMetro Industries Corp in Case No. 13:18-cv-00116, *SPG International, LLC* v. *InterMetro Industries Corp*, (26 pages).
Exhibit F, "Asserted Claims 1-3, 5, 7-12, 14-16 and 18 of U.S. Pat. No. 9,883,755 are Invalid under 35 U.S.C. § 112," submitted by InterMetro Industries Corp in Case No. 13:18-cv-00116, *SPG International, LLC* v. *InterMetro Industries Corp*, (10 pages).

* cited by examiner

SHELVING SUPPORT BRACKET ASSEMBLY

FIELD OF THE INVENTION

The present invention relates to support brackets, and more particularly to support brackets for shelving systems.

BACKGROUND

Strength and reliability are important issues relevant to shelving systems. In many conventional shelving system designs, a tradeoff exists between strength and reliability and other features, including manufacturability, material costs, and adjustability. Often times, individual shelves experience loading conditions that cause them to fail prematurely. Examples of failure include plastic (i.e., non-elastic) deformation due to bending or buckling, dynamic fracture, and fatigue-induced fracture. Cantilevered shelves are particularly susceptible to these types of failure when subjected to repeated impact loading, for example, when heavy loads are dropped onto the shelf from an appreciable height. Such failure leads to undesirable downtime, repair, or replacement, and the costs associated therewith.

SUMMARY

In one embodiment a shelving system includes a support post having a mounting surface and a plurality of vertically spaced retention members extending from the mounting surface. A shelf includes a bracket member configured for coupling to a first of the vertically spaced retention members. A support bracket includes an attachment portion configured for coupling to a second of the vertically spaced retention members adjacent the first vertically spaced retention member and a support portion configured for coupling to the bracket member.

In one embodiment of a support bracket for a shelving system having a support post with a plurality of retention members extending therefrom and a shelf having a bracket member configured for coupling to a first of the plurality of retention members, wherein the shelf further includes a support member secured to the bracket member, the support bracket includes an attachment portion configured for coupling to a second of the plurality of retention members, in which the second retention member is adjacent the first retention member. The support bracket further includes a support portion extending from the attachment portion and formed to be disposed substantially about the support member.

In one embodiment a shelving system includes a support post having a mounting surface and a plurality of vertically spaced retention members extending from the mounting surface. A shelf includes a bracket member configured for coupling to a first of the vertically spaced retention members and a support member secured to the bracket member. A support bracket includes an attachment portion having an aperture therethrough formed to receive a second of the vertically spaced retention members, in which the second retention member is adjacent the first retention member. The support bracket further includes a support portion comprising a generally C-shaped region forming a recess. The C-shaped region is formed to be disposed substantially about and to couple to the support member.

In one embodiment of a support bracket for a shelving system having a support post with a plurality of retention members extending therefrom and a shelf having a bracket member configured for coupling to a first of the plurality of retention members, wherein the shelf further includes a support member secured to the bracket member, the support bracket includes an attachment portion configured for coupling to a second of the plurality of retention members, in which the second retention member is spaced from the first retention member along a length of the support post. The support bracket further includes a support portion extending from the attachment portion and configured for supporting the support member.

Other features and aspects of the invention will become apparent by consideration of the following detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

Figure 1:
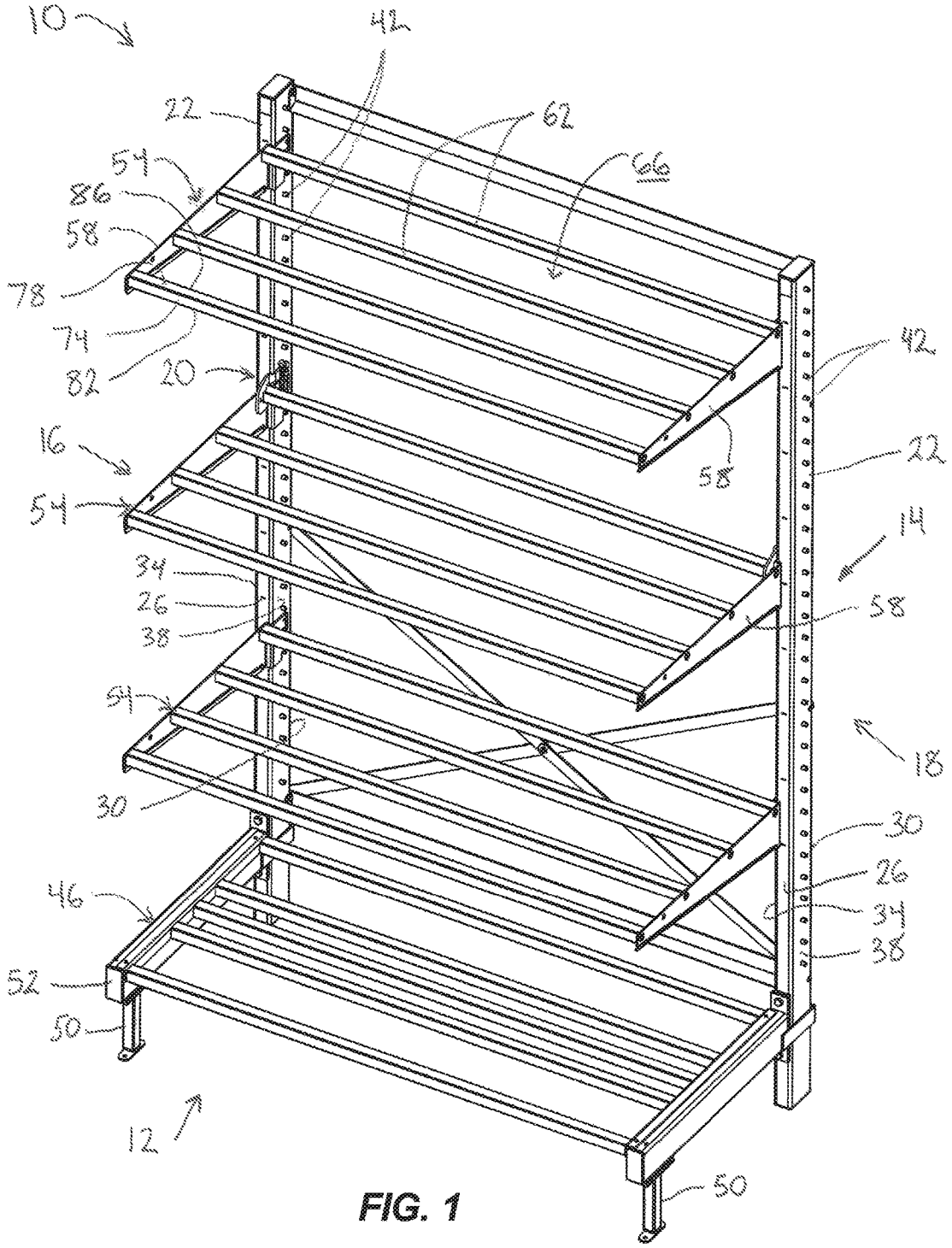
FIG. 1 is a perspective view of a shelving system including a support bracket.

FIG. 1 illustrates an exemplary shelving system 10 including one or more support brackets 20. The shelving system 10 is referenced herein with respect to a proximal end 12, a distal end 14, a left side 16, and a right side 18, the left and right sides 16, 18 referenced when viewed in the distal direction. The shelving system 10 includes a pair of vertical support posts 22 (i.e., left and right support posts 22) erected with respect to a ground or other support surface. Each post 22 defines a proximal side 26, a distal side 30, a left side 34, and a right side 38, and includes a plurality of vertically spaced retention members 42 in the form of support pins extending therethrough and protruding laterally from the left and right sides 34, 38. In the illustrated embodiment, the support pins 42 are spaced a distance of between about one inch and about four inches along the length of each post 22. In other embodiments, the support pins 42 can be spaced equally or unequally from each other. Each pin 42 is preferably press-fit in place but can be secured in any suitable manner generally known to those of skill in the art, e.g., welding, etc. In additional embodiments, the retention members can be in the form of hooks, ledges, or other shaped protrusions and forms affixed or otherwise coupled to each post 22.

A bottom shelf 46 nearest the ground or other support surface extends from the proximal side 26 of the posts 22 and includes a pair of support legs 50 at or near an end 52 that contacts the ground or other support surface to provide stability for the shelving system 10.

With continued reference to FIG. 1, the shelving system 10 includes one or more shelves 54 configured for coupling to the support posts 22. Each shelf 54 is mounted to the posts 22 by way of the support pins 42 and includes lateral brackets 58 with a plurality of support members 62 in the form of cross-braces extending therebetween to provide a generally planar support surface 66 for the shelf 54. Each of the support members 62 includes a proximal side 74 substantially perpendicular to the planar support surface 66, a top side 78 adjacent the planar support surface 66, a bottom side 82 opposite the top side 78, and a distal side 86 opposite the proximal side 74. As such, the illustrated support members 62 have a generally rectangular cross-section. However, other embodiments of a shelf 54 can include support members 62 having any other regularly or irregularly shaped cross-section, while still maintaining generally designated sides. For example, a support member having a circular cross-section (not shown) is oriented by definition to include top, bottom, front, and rear sides despite not having distinct surfaces separated by corners. In yet other embodiments, the lateral brackets 58 can be connected by a frame, sheet, series of bars or poles, mesh, screen, grate, or other form of support member extending between the lateral brackets 58 for purposes of supporting weight, through either direct contact or optionally through a separate supporting surface cover or platform upon which to store and/or display articles.

Figure 2:
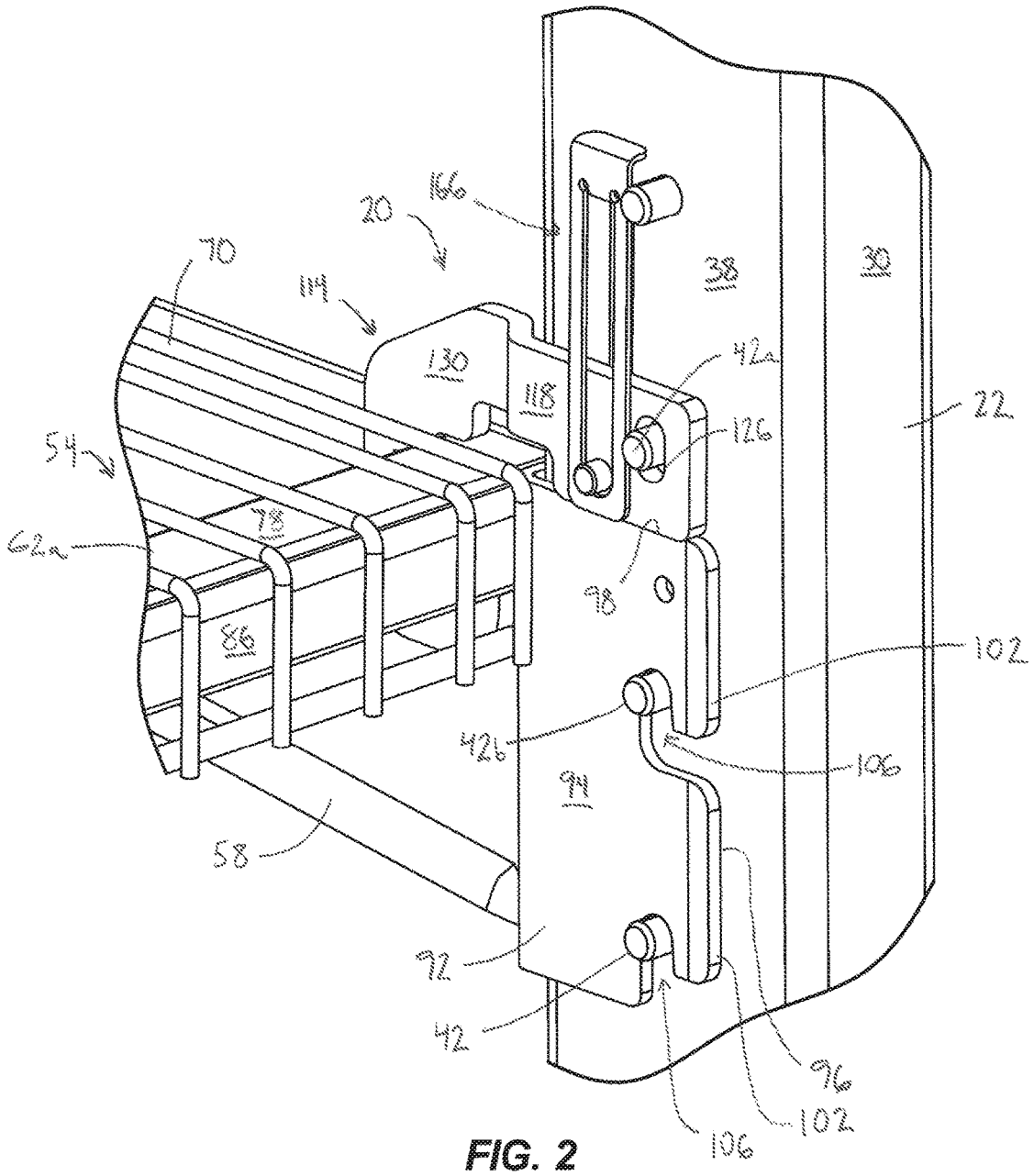
FIG. 2 is a partial perspective view of the shelving system showing the bracket identified in FIG. 1.
Figure 3:
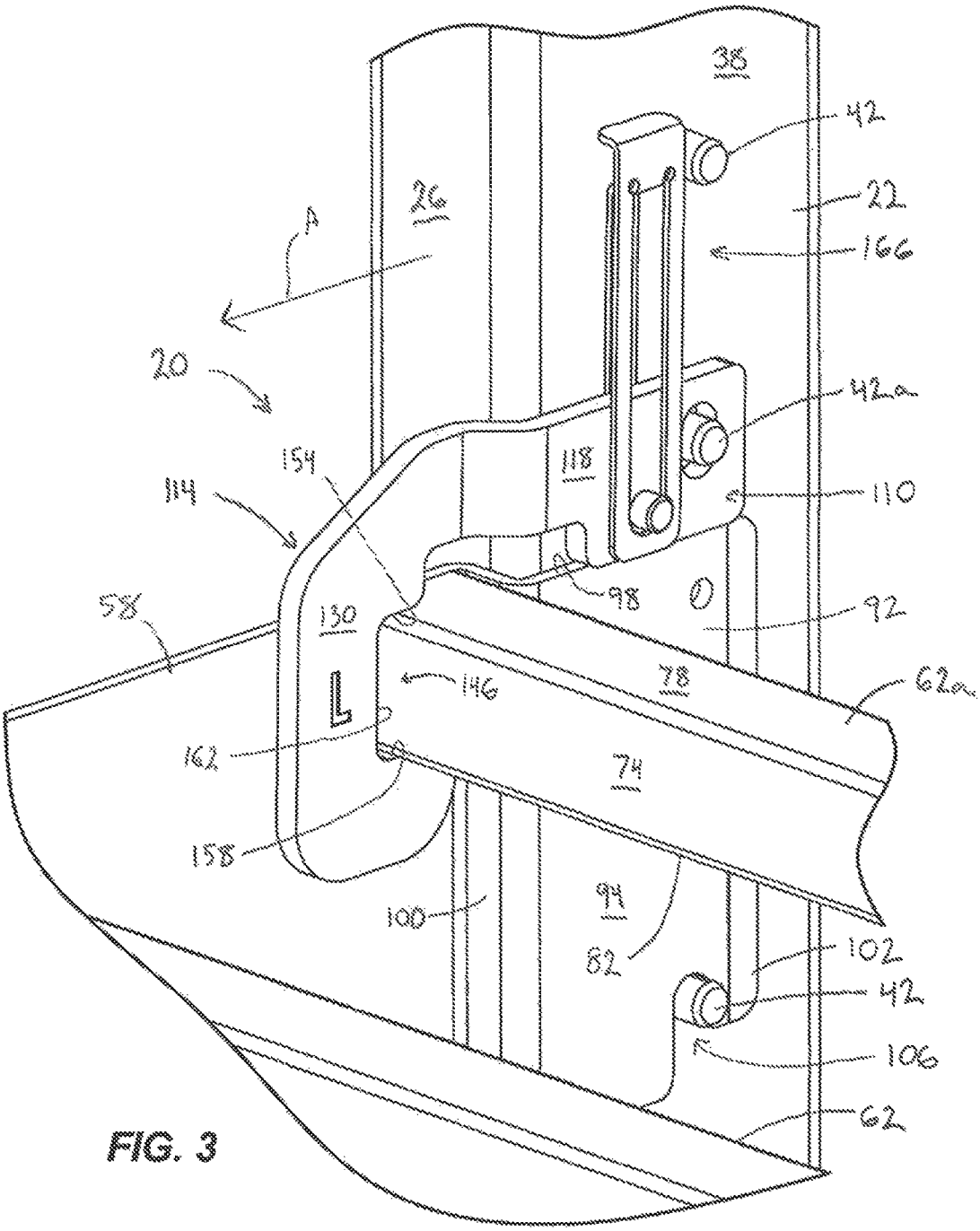
FIG. 3 is another partial perspective view of the shelving system showing the bracket identified in FIG. 1.

Referring to FIGS. 2 and 3, each of the lateral brackets 58 includes a flange member 92 having a first side 94 opposite the support post 22 when coupled thereto, a second side 96 adjacent the support post 22, and a top side 98 extending between the first side 94 and the second side 96. The flange member 92 also includes a bearing surface 100 adjacent and generally parallel to the proximal side 26 of the support post 22. Contact between the bearing surface 100 and the proximal side 26 prevents rotation of the shelf 54 on the post 22 due to the weight of the shelf 54 and additional loading placed upon the support members 62. As shown in FIG. 3, the proximal side 26 of the post 22 defines a plane such that a longitudinal direction 'A' is orthogonal to the plane.

In the illustrated embodiment, the flange members 92 include a plurality of distally-extending fingers 102 or hooks that curve downward to form recesses 106. The recesses 106 each receive and removably secure a pin 42 to mount the shelf 54 to the post 22, preventing translational and rotational movement of the shelf due to loading forces. The fingers 102 or hooks can be equally or unequally spaced but are positioned to correspond to the support pins 42.

Figure 7:
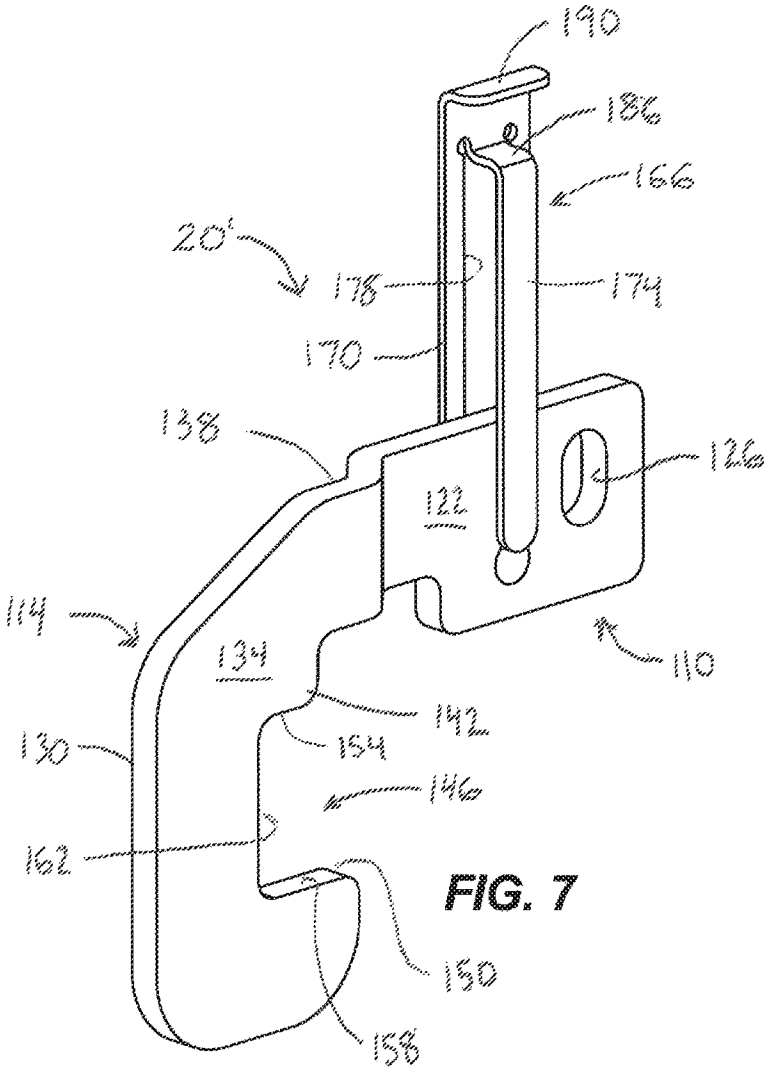
FIG. 7 is another perspective view of the support bracket of FIG. 6.

The support bracket 20, to be hereinafter described with reference to FIGS. 2-5, 8, and 9, is configured as a left-side bracket for coupling generally to the left side 16 of the shelving system 10. FIGS. 6 and 7 illustrate another support bracket 20' configured as a right-side support bracket for coupling generally to the right side of the shelving system 10. In other embodiments, the support brackets 20, 20' can be incorporated into the shelving system individually (e.g., for a shelving system having a single support post). The support bracket 20' of FIGS. 6 and 7 is a mirror image of the support bracket 20. As such, the support bracket 20' will not be described in detail herein, and like features of the support brackets 20 and 20' have been given like reference numerals. Although the support bracket 20 is described with respect to the shelving system 10 illustrated in FIG. 1, it should be understood that various embodiments of the support bracket 20 can be used with other types of shelving systems.

The support bracket 20 includes an attachment portion 110 and a support portion 114 continuously extending from the attachment portion 110. The attachment portion 110 includes a first side 118, a second side 122 opposite the first side 118, and an aperture 126 extending from the first side 118 to the second side 122. The aperture 126 is configured to receive a pin 42 projecting from the post 22 to couple the attachment portion 110 to the post 22. In other embodiments, the attachment portion 110 can be sized to include two or more apertures 126 to receive two or more pins 42 of the post 22. Alternative engagement features for coupling the attachment portion 110 with the post 22 or with posts of other shelving systems are within the scope of the present invention.

In the illustrated embodiment, the support bracket 20 is positioned on the post 22 with the second side 122 of the attachment portion 110 generally parallel and adjacent to the post 22, specifically the right side 38 of the post 22 (or the left side 34 for a support bracket 20'). The attachment portion 110 is positioned vertically adjacent the flange member 92 of a lateral bracket 58, and the aperture 126 of the attachment portion 110 receives the pin 42*a* adjacent the pin 42*b* engaged with the fingers 102 on the flange member 92, as illustrated in FIG. 2. As such, a portion of the support bracket 20 is positioned directly above the shelf 54. As shown in FIGS. 2 and 3, the attachment portion 110 abuts the top side 98 of the flange member 92, but in other embodiments, the attachment portion 110 can be spaced from the top side 98 of the flange member 92 and need not receive the pin adjacent the pin 42*b* (e.g., dependent on the spacing of the pins 42, the position of the aperture 126, or the shape of the attachment portion 110). In yet other embodiments, by varying the connection of the attachment portion 110 to the support portion 114, the support bracket 20 can be coupled to the post 22 such that the second side 122 of the attachment portion 110 is positioned laterally adjacent the flange member 92. In such an embodiment, the attachment portion 110 and the flange member 92 can be coupled to the same pin(s) 42.

Figure 5:
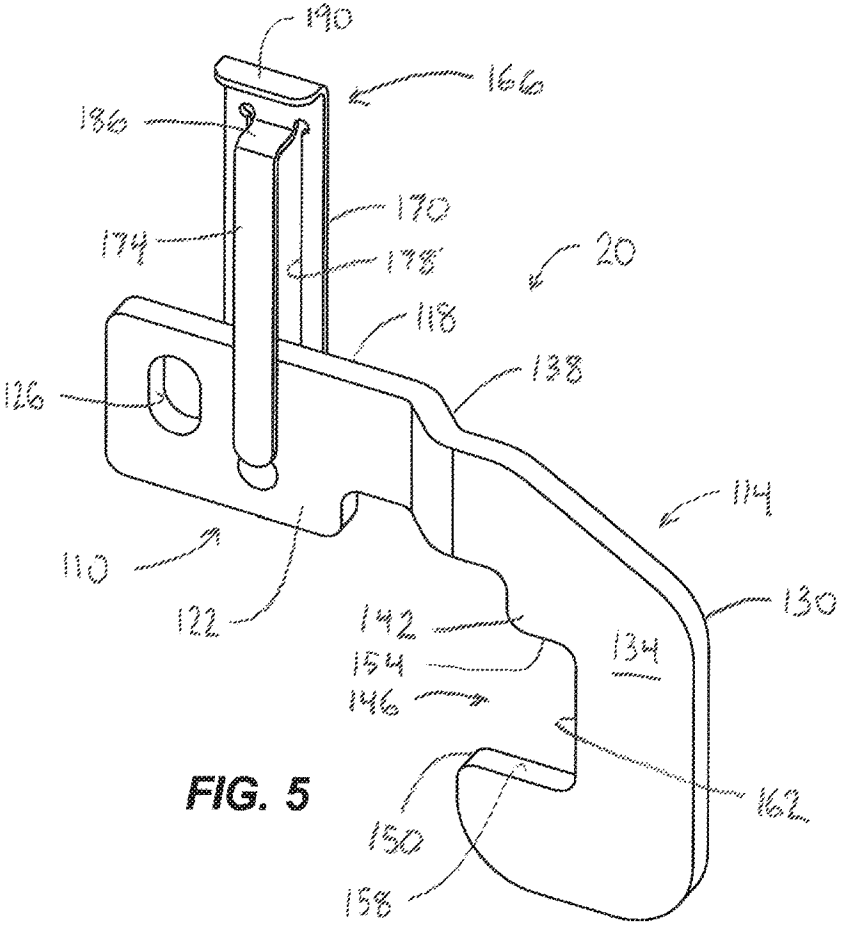
FIG. 5 is another perspective view of the support bracket of FIG. 2.
Figure 4:
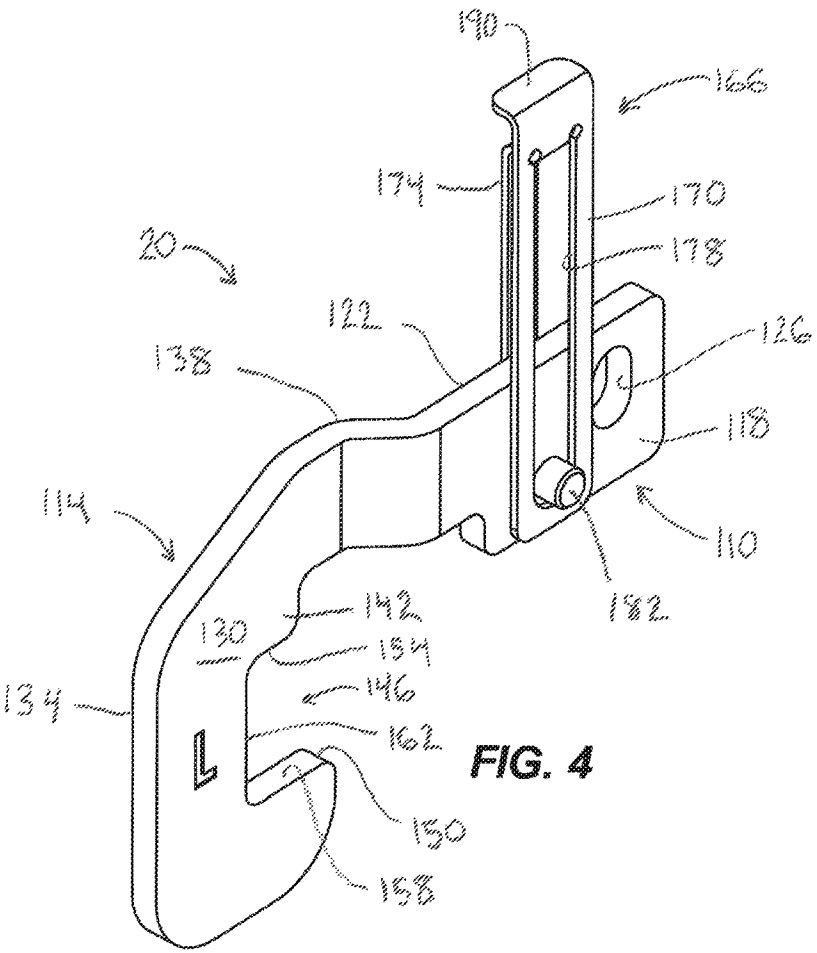
FIG. 4 is a perspective view of the support bracket of FIG. 2.
Figure 6:
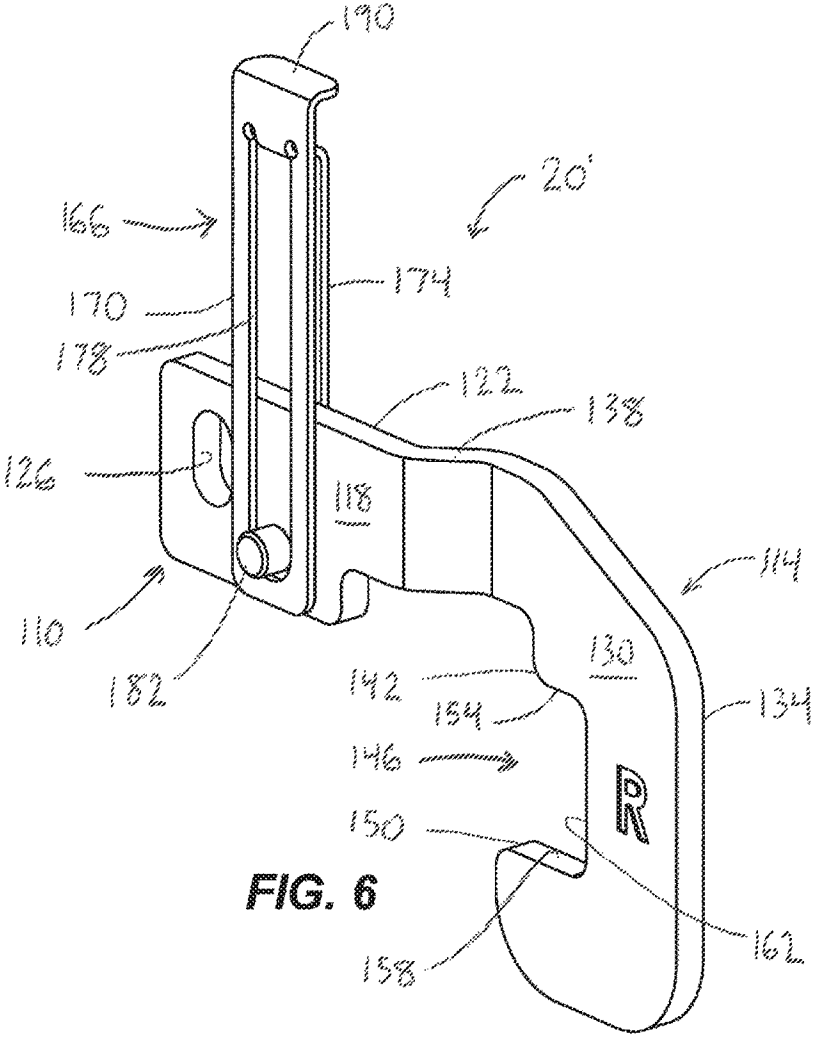
FIG. 6 is a perspective view of another support bracket for use with the shelving system of FIG. 1.
Figure 9:
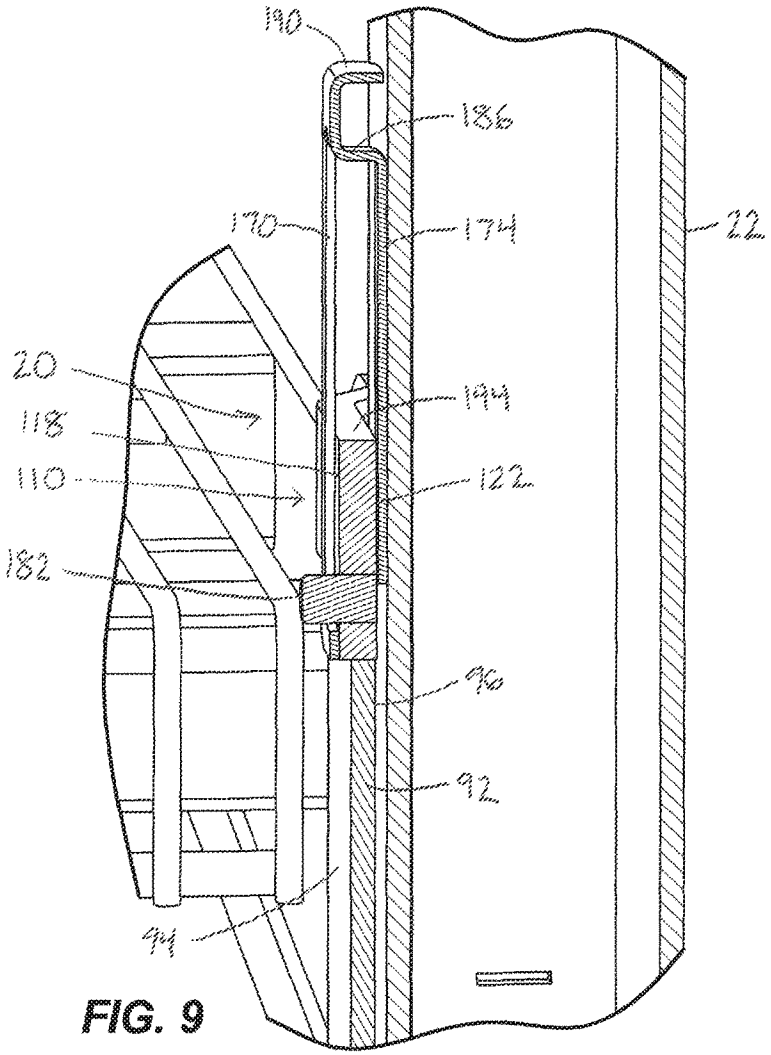
FIG. 9 is a cross-sectional view of a portion of the shelving system of FIG. 1, showing the lock member of the support bracket in an unlocked position.

Referring to FIGS. 4 and 5, the support portion 114 includes a first side 130 substantially parallel with the first side 118 of the attachment portion 110, and a second side 134 opposite the first side 130. A curved transition region 138 offsets the attachment portion 110 from the support portion 114. In other embodiments, the first and second sides 130, 134 of the support portion 114 can be generally coplanar with the first and second sides 118, 122 of the attachment portion 110. The support portion 114 further includes a generally C-shaped region 142 extending downward from the support portion (relative to the orientation of FIGS. 4 and 5). The C-shaped region 142 forms a recess 146 having an opening 150 oriented toward the attachment portion 110. The recess 146 is further defined by an upper wall 154, a lower wall 158, and an intermediate wall 162 extending between the upper wall 154 and the lower wall 158. The walls 154, 158, and 162 are configured to engage the distal support member 62*a* of the shelf 54 (when mounted to the post 22). Accordingly, in other embodiments, the recess 146 can have other shapes and/or orientations suitable to engage with the support member 62*a* or other shaped or sized member extending between lateral brackets 58 and supporting or otherwise forming the support surface cover or platform 66 upon which to store and/or display articles. For example, in some embodiments, the recess 146 can include a single curved wall to engage with a support member having a circular cross-section. In other embodiments with alternative mounting of the attachment portion 110, the C-shaped region 142 can extend upward from the support portion 114 to engage the support member 62*a*.

With reference to FIG. 3, the recess 146 of the support portion 114 is disposed about a portion of the distal support member 62*a* of the shelf 54 to engage and secure or otherwise support the support member 62*a* when the support bracket 20 is installed on the post 22. The upper wall 154 is positioned adjacent the top side 78 of the distal support member 62*a*, the intermediate wall 162 is positioned adjacent the proximal side 74 of the distal support member 62*a*, and the lower wall 158 is positioned adjacent the bottom side 82 of the distal support member 62*a*, i.e., the support portion 114 is disposed substantially about the support member 62*a*. At least one of the sides (e.g., the bottom side 82 and/or the proximal side 74) of the distal support member 62*a* contacts or bears against the adjacent wall (i.e., the lower 158 and/or intermediate wall 162) to transmit loading from the lateral bracket 58 through the distal support member 62*a* to the support bracket 20. The support bracket 20 then transmits this loading to the support post 22. Accordingly, the support bracket 20 reduces the stresses experienced by the lateral bracket 58 and strengthens the shelving system 10.

The support brackets 20, 20' are preferably formed from a single piece of metal, for example, by a stamping or cutting process.

Referring to FIGS. 4, 5, 8, and 9, the support bracket 20 includes a lock member 166 slidable relative to the support bracket 20 between an unlocked position (FIG. 9) in which the lock member 166 permits movement of the support bracket 20 relative to the flange member 92 and a locked position (FIG. 8) in which the lock member 166 inhibits movement of the support bracket 20 relative to the flange member 92. The lock member 166 includes a first leg 170 adjacent the first side 118 of the attachment portion 110 and a second leg 174 adjacent the second side 122 of the attachment portion 110. The first leg 170 includes a slot 178 extending therethrough, which receives a laterally extending projection 182 of the attachment portion 110 to couple the lock member 166 to the attachment portion 110. The slot 178 is slidable along the projection 182 as the lock member 166 moves between the locked position and the unlocked position. The lock member 166 also includes a connecting portion 186 extending between the first and second legs 170, 174, and an upper surface 190 extending generally perpendicular to the legs 170, 174 to facilitate positioning of the lock member 166. In the illustrated embodiment, the lock member 166 is integrally formed from a single piece of metal. For example, the second leg 174 can be stamped or cut from the first leg 170 to thereby define the slot 178, then bent to laterally offset the second leg 174 from the first leg 170, forming the connecting portion 186. In other embodiments, the lock member 166 can be formed from multiple pieces and/or through any suitable process.

Figure 8:
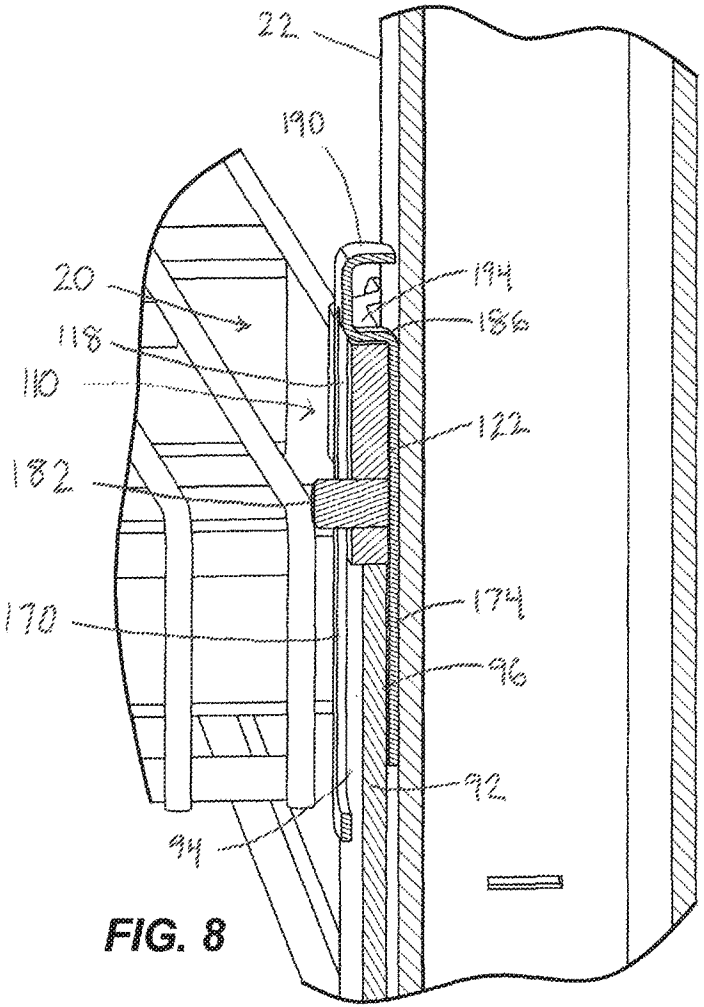
FIG. 8 is a cross-sectional view of a portion of the shelving system of FIG. 1, showing a lock member of the support bracket in a locked position.

With reference to FIG. 8, in the locked position, the connecting portion 186 of the lock member 166 abuts a top side 194 of the attachment portion 110 to provide an indication that the lock member 166 is fully engaged in the locked position. In the locked position of FIG. 8, the first leg 170 of the lock member 166 spans across both the first side 118 of the attachment portion 110 and the first side 94 of the flange member 92. Similarly, the second leg 174 of the lock member 166 spans across the second side of the attachment portion and the second side 96 of the flange member 92, disposed in the space defined between the surface 122 of bracket 20 and surface 96 of flange member 92, on the one hand, and the surface 38 of support post 22, on the other hand. As such, the attachment portion 110 and the flange member 92 are captured between the first and second legs 170, 174 of the lock member 166 and held in alignment. This prevents lateral movement of the support bracket 20 relative to the flange member 92 and keeps the bracket 20 in its optimal position for providing support to the shelf 54.

The support brackets 20 and 20' thereby assist in mitigating the mechanical stresses developed in the lateral brackets 58 due to shelf loading, such as impact loading, by providing a countering force to such loading. The support bracket can be readily installed without the need for any tools or external devices to new or existing shelving systems having a variety of different configurations, shelf depths, and lengths.

Various features of the invention are set forth in the following claims.

What is claimed is:

1. A support bracket assembly for a shelving system having a support post with a mounting portion including a first surface and a second surface opposed to and facing away from the first surface, a third surface that defines a plane and extends between and orthogonal to the first and second surfaces, a plurality of support pins fixed to the support post and extending outwardly from the first and second surfaces, a first transition surface extending between the first surface and the third surface of the support post, and a second transition surface extending between the second surface and the third surface of the support post, the support bracket assembly configured to be removably coupled to the support post and comprising:

first and second attachment flanges each formed as a planar portion, each planar portion configured to attach to one of the first surface or the second surface of the support post, wherein each planar portion is configured such that in an assembled state of the shelving system the planar portions are positioned parallel to one another and each planar portion is positioned adjacent to and extends along one of the first surface or the second surface of the support post toward a shelf coupled to the support post, wherein each planar portion includes an aperture configured to releasably engage any one of the plurality of support pins, the aperture in the second attachment flange formed as a slot with an open end;

a first transition portion extending from the first attachment flange and a second transition portion extending from the second attachment flange, wherein each transition portion is configured such that in the assembled state of the shelving system the first transition portion extends across one of the first or second transition surfaces of the support post and the second transition portion extends across one of the first or second transition surfaces of the support post; and a first support portion coupled to the first transition portion and a second support portion coupled to the second transition portion such that in the assembled state of the shelving system each of the support portions extends in a longitudinal direction that is orthogonal to the plane defined by the third surface of the support post, wherein the first support portion includes a recess region and is configured such that in the assembled state of the shelving system the recess region is disposed above the slot with the open end and receives and supports a portion of the shelf to inhibit movement of the shelf in a direction orthogonal to the plane defined by the third surface of the support post, and wherein the planar portions are each configured such that in the assembled state of the shelving system the planar portions cooperate to transmit a loading force from the shelf to the support post.

2. The support bracket assembly of claim 1, wherein the first support portion of the support bracket assembly is configured to engage and support a bottom portion of the shelf.

3. The support bracket assembly of claim 1, wherein the first support portion and the recess region are formed from a single piece of material.

4. The support bracket assembly of claim 1, wherein the first transition portion and the first support portion are formed from a single piece of material.

5. The support bracket assembly of claim 1, wherein the first and second attachment flanges are each configured such that in the assembled state of the shelving system the planar portions of both the first and second attachment flanges of the support bracket assembly are both attached to only the first surface or second surface of the support post.

6. The support bracket assembly of claim 1, wherein the recess region is positioned relative to the first support portion such that in the assembled state of the shelving system the recess region supports a bottom of the shelf above the slot with the open end.

7. The support bracket assembly of claim 1, wherein the recess region is positioned relative to the first support portion such that in the assembled state of the shelving system the recess region supports a bottom of the shelf above a bottom of one of the attachment flanges.

8. The support bracket assembly of claim 1, wherein the planar portion of the first attachment flange and the planar portion of the second attachment flange are separable from each other.

9. The support bracket assembly of claim 1, wherein the second attachment portion includes two apertures that are each configured such that in the assembled state of the shelving system one aperture of the two apertures opens in a first direction away from the shelf coupled to the support post and the other aperture of the two apertures opens in a second direction different than the first direction.

10. The support bracket assembly of claim 1, wherein the recess region is separable from one of the planar portions.

11. The support bracket assembly of claim 1, wherein the support bracket assembly is configured such that in the assembled state of the shelving system the support bracket assembly supports the shelf such that a top side of the shelf does not extend above a top side of the second support portion.

12. The support bracket assembly of claim 1, wherein the first support portion is configured such that upon receiving the portion of the shelf by the recess region, the recess region is constrained from movement toward the plane.

13. The support bracket assembly of claim 1, wherein the first support portion is configured such that upon receiving the portion of the shelf by the recess region, the recess region constrains movement of the shelf away from the plane.

14. The support bracket assembly of claim 1, wherein each planar portion is configured such that in an assembled state of the shelving system the planar portions are positioned parallel to one another and each planar portion is in contact with the one of the first surface or the second surface of the support post, and wherein the first support portion is configured such that in the assembled state of the shelving system the shelf does not extend beyond a top side of the second support portion.

15. A shelving system comprising:

first and second support posts, each support post defining a mounting portion comprising a first surface and a second surface opposed to and facing away from the first surface, each of the first and second surfaces of each support post presenting a plurality of retention members formed as support pins that are fixed to and extend laterally away from the first and second surfaces, and each support post including a third surface extending between and orthogonal to the first and second surfaces, wherein the third surface of the support post defines a plane;

a shelf; and a pair of support bracket assemblies, wherein each support bracket assembly of the pair of support bracket assemblies is configured such that in an assembled state of the shelving system one support bracket assembly is coupled to the first support post to support one side of the shelf and the other support bracket assembly is coupled to the second support post to support an opposite side of the shelf, and wherein each support bracket assembly of the pair of support bracket assemblies comprises first and second attachment flanges, wherein each attachment flange of the support bracket assembly is configured such that in the assembled state of the shelving system the first and second attachment flanges are positioned parallel to one another and each of the first and second attachment flanges is removably coupled to a same support post of the first and second support posts, wherein each of the first and second attachment flanges is formed as a planar portion, wherein each planar portion is configured such that in the assembled state of the shelving system each planar portion is positioned adjacent to and extends along one of the first or second surfaces of the same support post, wherein each of the planar portions includes an aperture configured to releasably engage any one of the plurality of retention members, the aperture in the second attachment flange formed as a slot with an open end, a first transition portion extending from the first attachment flange and a second transition portion extending from the second attachment flange, and a first support portion coupled to the first transition portion and a second support portion coupled to the second transition portion such that in the assembled state of the shelving system each support portion extends in a longitudinal direction orthogonal to the plane defined by the third surface of the same support post, wherein the first support portion includes a recess region and is configured such that in the assembled state of the shelving system the recess region supports a bottom side of the shelf above a bottom side of one of the first and second attachment flanges and above the slot with the open end, and wherein the recess region is positioned relative to the first support portion such that in the assembled state of the shelving system the recess region receives a portion of the shelf and inhibits movement of the shelf in a direction orthogonal to the plane defined by the third surface of the same support post, and wherein the planar portions are each configured such that in the assembled state of the shelving system the planar portions cooperate to transmit a loading force from the shelf to the same support post.

16. The shelving system of claim 15, wherein each support bracket assembly is configured such that in the assembled state of the shelving system the planar portions of both the first and second attachment flanges of each support bracket assembly of the pair of support bracket assemblies are both attached to only the first surface or second surface of the same support post.

17. The shelving system of claim 15, wherein the first support portion and the recess region are formed from a single piece of material.

18. The shelving system of claim 15, wherein the recess region is configured such that in the assembled state of the shelving system the recess region receives and supports a bottom portion of the shelf.

19. The shelving system of claim 15, wherein the planar portion of the first attachment flange and the planar portion of the second attachment flange are separable from each other.

20. The shelving system of claim 15, wherein the second attachment flange includes two apertures that are each configured such that in the assembled state of the shelving system one aperture of the two apertures opens in a first direction away from the shelf and the other aperture of the two apertures opens in a second direction different than the first direction.

21. The shelving system of claim 15, wherein the recess region is separable from one of the planar portions.

22. The shelving system of claim 15, wherein the first attachment flange and the second attachment flange are each configured such that in the assembled state of the shelving system the first attachment flange and the second attachment flange are in contact.

23. The shelving system of claim 15, wherein the first support portion is configured such that upon receiving the portion of the shelf by the recess region, the recess region is constrained from movement toward the plane.

24. The shelving system of claim 15, wherein the first support portion is configured such that upon receiving the portion of the shelf by the recess region, the recess region constrains movement of the shelf away from the plane.

25. The shelving system of claim 15, wherein each planar portion is configured such that in the assembled state of the shelving system each planar portion is in contact with the one of the first or second surfaces of the same support post, and wherein the first support portion is configured such that in the assembled state of the shelving system the shelf does not extend beyond a top side of the second support portion.

26. A shelving system comprising:

first and second support posts, each support post defining a mounting portion comprising a first surface and a second surface opposed to and facing away from the first surface, each of the first and second surfaces of each support post presenting a plurality of retention members formed as support pins that are fixed to and extend away from the first and second surfaces, and each support post including a third surface extending between and orthogonal to the first and second surfaces, wherein the third surface of the support post defines a plane; and a pair of support bracket assemblies, each support bracket assembly of the pair of support bracket assemblies is configured such that in an assembled state of the shelving system one support bracket assembly of the pair of support bracket assemblies is coupled to the first support post to support one side of a shelf and the other support bracket assembly of the pair of support bracket assemblies is coupled to the second support post to support an opposite side of the shelf, and wherein each support bracket assembly of the pair of support bracket assemblies comprises first and second attachment flanges, wherein each attachment flange of the support bracket assembly is configured such that in the assembled state of the shelving system the first and second attachment flanges are positioned parallel to one another and each of the first and second attachment flanges is removably coupled to a same support post of the first and second support posts, wherein each of the first and second attachment flanges is formed as a planar portion, wherein each planar portion is configured such that in the assembled state of the shelving system each planar portion is positioned adjacent to and extends along one of the first surface or the second surface of the same support post, wherein each planar portion includes an aperture for releasable attachment with any one of the plurality of retention members of the same support post, the aperture in the second attachment flange formed as a slot with an open end, a first transition portion extending from the first attachment flange and a second transition portion extending from the second attachment flange, and a first support portion coupled to the first transition portion and a second support portion coupled to the second transition portion such that in the assembled state of the shelving system each support portion extends in a longitudinal direction orthogonal to the plane defined by the third surface of the same support post wherein the first support portion includes a support member to engage a portion of the shelf and is configured such that in the assembled state of the shelving system the support member is disposed above the slot with the open end and inhibits movement of the shelf in a direction orthogonal to the plane defined by the third surface of the same support post, and wherein the planar portions are configured such that in the assembled state of the shelving system the planar portions cooperate to transmit a loading force from the shelf to the same support post.

27. The shelving system of claim 26, wherein each support bracket assembly of the pair of support bracket assemblies is configured such that in the assembled state of the shelving system the planar portions of both the first and second attachment flanges of each support bracket assembly of the pair of support bracket assemblies are both attached to only the first surface or second surface of the same support post.

28. The shelving system of claim 26, wherein the planar portion of the first attachment flange and the planar portion of the second attachment flange are separable from each other.

29. The shelving system of claim 26, wherein the support member comprises a recess region and the support member is configured such that in the assembled state of the shelving system the recess region receives a portion of one side of the shelf.

30. The shelving system of claim 29, wherein the support member is configured such that upon receiving the portion of the one side of the shelf by the recess region, the recess region is constrained from movement toward the plane.

31. The shelving system of claim 29, wherein the support member is configured such that upon receiving the portion of the one side of the shelf by the recess region, the recess region constrains movement of the shelf away from the plane.

32. The shelving system of claim 26, wherein the first attachment flange and the second attachment flange are each configured such that in the assembled state of the shelving system the first attachment flange and the second attachment flange are in contact.

33. The shelving system of claim 26, wherein the support member is separable from one of the planar portions.

34. The shelving system of claim 26, wherein each planar portion is configured such that in the assembled state of the shelving system each planar portion is in contact with the one of the first surface or the second surface of the same support post, and wherein the first support portion is configured such that in the assembled state of the shelving system the shelf does not extend beyond a top side of the second support portion.

35. A shelving system comprising:

first and second support posts, each support post defining a mounting portion comprising a first surface and a second surface facing away from the first surface, the mounting portion of each support post presenting a plurality of retention members formed as support pins that are fixed to and extend laterally away from the first and second surfaces, and each support post including a third surface extending between and orthogonal to the first and second surfaces, wherein the third surface of each support post defines a plane;

a shelf; and a pair of support bracket assemblies, wherein each support bracket assembly of the pair of support bracket assemblies is configured such that in an assembled state of the shelving system one support bracket assembly of the pair of support bracket assemblies is coupled to the first support post to support one side of the shelf and the other support bracket assembly of the pair of support bracket assemblies is coupled to the second post to support an opposite side of the shelf, and wherein each support bracket assembly of the pair of support bracket assemblies comprises first and second attachment flanges, wherein each attachment flange is configured such that in the assembled state of the shelving system the first and second attachment flanges are positioned parallel to one another and each of the first and second attachment flanges is removably coupled to a same support post of the first and second support posts, wherein each of the first and second attachment flanges is formed as a planar portion, wherein each planar portion is configured such that in the assembled state of the shelving system each planar portion is positioned adjacent to and extends along one of the first or second surfaces of the same support post, wherein each planar portion includes an aperture configured for releasable attachment with any one of the plurality of retention members of the same support post, the aperture in the second attachment flange formed as a slot with an open end, a first transition portion extending from the first attachment flange and a second transition portion extending from the second attachment flange, and a first support portion coupled to the first transition portion and a second support portion coupled to the second transition portion such that in the assembled state of the shelving system each support portion extends in a longitudinal direction orthogonal to the plane defined by the third surface of the same support post, wherein the first support portion includes a recess region that is separable from one of the planar portions, wherein the recess region is positioned relative to the support portion such that in the assembled state of the shelving system the recess region is positioned above the slot with the open end and receives a bottom portion of the shelf and inhibits movement of the shelf in a direction orthogonal to the plane defined by the third surface of the same support post, wherein the first support portion is configured such that in the assembled state of the shelving system the shelf does not extend beyond a top side of the second support portion, and wherein the planar portions are each configured such that in the assembled state of the shelving system the planar portions cooperate to transmit a loading force from the shelf to the same support post.

36. The shelving system of claim 35, wherein the planar portion of the first attachment flange and the planar portion of the second attachment flange are separable from each other.

37. The shelving system of claim 35, wherein the second attachment flange includes two apertures and each aperture is configured such that in the assembled state of the shelving system one aperture of the two apertures opens in a first direction away from the shelf and the other aperture of the two apertures opens in a second direction different than the first direction.

38. The shelving system of claim 35, wherein the first and second attachment flanges are each configured such that in the assembled state of the shelving system the planar portions of both the first and second attachment flanges of each support bracket assembly of the pair of support bracket assemblies are both attached to only the first surface or second surface of the same support post of the first and second support posts.

39. The shelving system of claim 35, wherein the first attachment flange and the second attachment flange are each configured such that in the assembled state of the shelving system the first attachment flange and the second attachment flange are in contact.

40. The shelving system of claim 35, wherein the first support portion is configured such that upon receiving the bottom portion of the shelf by the recess region, the recess region is constrained from movement toward the plane.

41. The shelving system of claim 35, wherein the first support portion is configured such that upon receiving the bottom portion of the shelf by the recess region, the recess region constrains movement of the shelf away from the plane.

42. The shelving system of claim 35, wherein each planar portion is configured such that in the assembled state of the shelving system each planar portion is in contact with the one of the first or second surfaces of the same support post.

* * * * *